United States Patent [19]

Butzen

[11] Patent Number: 4,898,524

[45] Date of Patent: Feb. 6, 1990

[54] FLUID DRIVEN ROTARY MOTOR

[75] Inventor: James K. Butzen, Grayslake, Ill.

[73] Assignee: Snap-on Tools Corporation, Kenosha, Wis.

[21] Appl. No.: 302,431

[22] Filed: Jan. 27, 1989

[51] Int. Cl.[4] ..... F01C 1/344; F01C 19/08

[52] U.S. Cl. ..... 418/136; 418/140; 418/259

[58] Field of Search ..... 418/110, 111, 131, 133, 418/134, 135, 136, 137, 140, 144, 182, 259, 260, 261, 262, 263, 264, 265, 266, 267, 268, 269

[56] References Cited

U.S. PATENT DOCUMENTS

| | | | |
|---|---|---|---|
| 2,097,718 | 11/1937 | Bilderbeck . | |
| 3,183,843 | 5/1965 | Cockburn . | |
| 3,193,910 | 7/1965 | Evans | 29/149.5 |
| 3,309,965 | 3/1967 | Weickgenannt | 418/133 |
| 3,804,562 | 4/1974 | Hansson | 418/107 |
| 3,873,253 | 3/1975 | Eickmann | 418/261 |
| 3,909,158 | 9/1975 | Martin | 418/257 |
| 3,934,657 | 1/1976 | Danielson | 173/169 |
| 4,380,270 | 4/1983 | Ludwig | 173/163 |
| 4,435,140 | 3/1984 | Inagaki et al. | 418/259 |
| 4,479,763 | 10/1984 | Sakamaki | 418/269 |
| 4,526,524 | 7/1985 | Rond et al. | 418/255 |
| 4,631,012 | 12/1986 | Eckman | 418/70 |
| 4,702,684 | 10/1987 | Takao et al. | 418/259 |

FOREIGN PATENT DOCUMENTS 1106604 5/1961 Fed. Rep. of Germany ..... 418/135

OTHER PUBLICATIONS

Polaroid Snap-Shot of Fluid Driven Rotary Motor Manufactured by Applicants Assignee (one end plate removed).

*Primary Examiner*—Michael Koczo
*Assistant Examiner*—John A. Savio, III
*Attorney, Agent, or Firm*—Emrich & Dithmar

[57] ABSTRACT

An improved, fluid driven rotary motor of the vane type includes a housing having a rotor cover disposed between a pair of end plates, a rotor rotatably mounted in the housing and a drive shaft torsionally affixed to the rotor. In the improved rotary motor of the invention, the rotor is slidable on the drive shaft so that the axial position of the rotor is permitted to "float" with respect to the housing. The degree of axial displacement, or degree of "float", is limited by a compression spring means and an abutting ring which cooperate with a pair of bearings in the end plates so that contact between the rotor and housing is avoided. Furthermore, the compression spring means is operative to force the rotor to return to a predetermined normal operating position upon axial displacement of the rotor.

13 Claims, 1 Drawing Sheet

FLUID DRIVEN ROTARY MOTOR

BACKGROUND OF THE INVENTION

The present invention relates generally to fluid driven rotary motors of the vane type which include a rotor rotatably mounted in a housing. More specifically, the present invention relates to an improved fluid driven rotary motor which includes novel means for securing the axial position of the rotor so that contact between the rotor and housing can be avoided.

Fluid driven rotary motors, and for that matter rotary compressors, of the vane type, generally comprise a housing which includes a rotor cover disposed between a pair of end plates and a cylindrical rotor, which defines opposite axial faces, rotatably mounted in the housing. The end plates may have a bore formed therein which receives the rotor in a journaled manner. The rotor is formed with a plurality of radially extending slots, each of which receives a vane in a slidable manner. The housing, rotor and vanes cooperate with one another to define a plurality of variable working volumes between the vanes. A compressed fluid is introduced into the variable working volumes through a first orifice which is formed in the housing. Likewise, the compressed fluid is exhausted through a second orifice formed in the housing. Expansion of the compressed fluid within the variable working volumes, and subsequent exhaust, causes rotation of the rotor. A drive shaft, torsionally affixed to the rotor, communicates the rotation to a tool or other apparatus.

The axial position of the rotor, with respect to the housing, is maintained so that the vanes remain in proper relation with the rotor cover. In some prior art fluid driven motors, axial displacement of the rotor has been limited by contact between the axial faces of the rotor and the end plates. Such contact frequently results in substantial wear and damage to the contacting parts as well as a loss of power output by the motor.

Typically, the spacing between the axial faces of the rotor and the end plates is maintained very small, on the order of 0.0005 inch. This close tolerance is necessary to prevent leakage of the compressed fluid between the variable working volumes, via a path across the axial faces of the rotor.

Such close spacing has at least two drawbacks. First of all, foreign particles may be carried by the compressed fluid and become lodged between an end plate and axial face of the rotor. This can exacerbate the problems of scoring and wear or even cause stalling of the rotor. Secondly, attempts to further limit the axial displacement of the rotor, so as to entirely avoid contact between the axial faces of the rotor and the housing end plates, are extremely difficult because of the limited tolerable range for axial position.

In U.S. Pat. No. 3,804,562, assigned to Atlas Copco Aktiebolag, the axial position of the rotor is adjusted by means of a set screw. The Atlas invention has the drawback that the axial position of the rotor is manually set, without the ability to see or measure the true position of the rotor with respect to each end plate. Thus, the user can only assume that the proper axial position has been achieved if, in fact, the air motor functions. Furthermore, the set screw has the possibility of loosening during operation of the motor.

In U.S. Pat. No. 4,435,140, assigned to Nippon Sohen, Inc., the axial position of the rotor in a rotary compressor, is limited by contact between the vanes and end plates. Thus, the vanes may bear the entire weight of the rotor during operation. Because the vanes and end plates are in relative rotational motion, it is expected that contact therebetween would cause substantial wear in these two portions. While such a configuration may be suitable for a rotary compressor, which can operate at relatively low rpm, it would not likely be suitable for a fluid driven rotary motor which operates at relatively high rpm. At high speeds, rapid deterioration of the vane material would be expected.

SUMMARY OF THE INVENTION

It is therefore an object of the present invention to provide an improved, fluid driven, rotary motor of the vane type, wherein wear and scoring caused by contact between the axial faces of the rotor working portion and the housing end plates is eliminated.

Another object of the present invention is to provide an improved, fluid driven, rotary motor of the vane type, wherein the rotor is permitted to undergo limited displacement in the axial direction with respect to the motor housing.

Still another object of the present invention is to provide an improved, fluid driven rotary motor of the vane type wherein axial displacement of the rotor, from a predetermined normal operating position, causes compression spring means to return the rotor to the predetermined position.

The improved fluid driven rotary motor is of the type which comprises a rotor housing that includes a rotor cover disposed between a pair of end plates, the end plates each having a bore formed therein, a rotor having a relatively large diameter, cylindrical working portion disposed between a pair of relatively small diameter, cylindrical end portions, the working portion defining a pair of axial faces each end portion defining a single face, a drive shaft which defines opposite ends and which is coaxial with the rotor and torsionally affixed thereto, the rotor having a plurality of radially extending slots formed therein, a plurality of vanes, respectively slidably received in the slots, two bearings, each having an inner race and an outer race being respectively mounted in the end plate bores so as to be radially supported therein, the rotor and the drive shaft being rotatably mounted in the housing, the rotor end portions and the drive shaft ends being journaled in the end plate bores and inner bearing races, respectively, and the housing, the end plates, the rotor and the vanes cooperating with one another to define a plurality of variable, working volumes, whereby the introduction of a compressed fluid in the variable working volumes, its expansion therein and subsequent exhaust therefrom, causes rotation of the rotor and drive shaft.

In accordance with the invention, the improvement comprises means for axially fixing the opposite ends of the drive shaft to the inner race of the bearings, the rotor being axially slidable with respect to the drive shaft, an abutting ring having a hole formed therein, and being disposed intermediate the axial face of one of the rotor end portions and the inner race of the bearing associated therewith so that the drive shaft is received in the hole, the abutting ring abutting the axial face of the rotor end portion and the inner race of the bearing associated therewith and not contacting the outer race thereof, axial compression spring means disposed between the axial face of the other rotor end portion and the inner race of the bearing associated therewith, the axial compression spring means abutting the axial face of the other rotor end portion and the inner race of the bearing associated therewith and not contacting the outer bearing race thereof, and the axial displacement of the rotor, with respect to the housing, being limited by the abutting ring and compression spring means cooperating with the axial faces on the end portions and the inner races of the bearings associated therewith, respectively, so that contact between the axial faces on the working portion and the end plates is avoided.

The invention consists of certain novel features and a combination of parts hereinafter fully described, illustrated in the accompanying drawings, and particularly pointed out in the appended claims, it being understood that various changes in the details may be made without departing from the spirit or sacrificing any of the advantages of the present invention.

DETAILED DESCRIPTION OF THE PREFERRED EMBODIMENT

Figure 1:
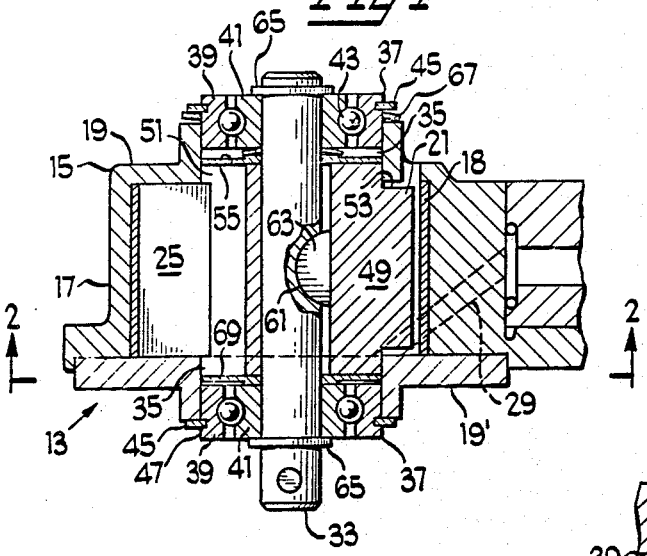
FIG. 1 is a fragmentary cross-sectional view of the improved fluid driven, rotary motor of the present invention which cross-section is taken through the housing rotor and ball bearings, in the axial direction.
Figure 2:
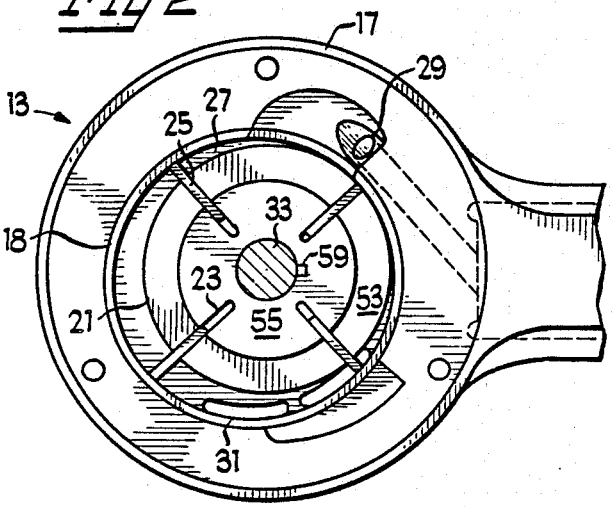
FIG. 2 is a view taken along the lines 2—2 of FIG. 1, with the bottommost end plate, bearing, and sealing washer as depicted in FIG. 1, removed.

Referring now to the drawings, and in particular to FIGS. 1 and 2, there is illustrated the preferred embodiment of the improved, fluid driven rotary motor of the invention, generally indicated by reference numeral 13. The motor 13 comprises a housing 15 which includes a rotor cover 17 disposed between a pair of end plates 19 and 19', a rotor 21 rotatably mounted in the housing 15, which rotor is formed with a plurality of radially extending slots 23, and a plurality of vanes 25, each of which is slidably received in slots 23. The housing 15, the rotor 21 and the vanes 25 cooperate so as to define a plurality of variable, working volumes 27 between the vanes 25 (FIG. 2). A compressed fluid is introduced into the variable working volumes 27 through a first orifice 29 formed in housing 15. Expansion of the compressed fluid in variable working volumes 27, and its subsequent exhaust through a second orifice 31, also formed in the housing, causes rotation of the rotor 21. A drive shaft 33 is torsionally affixed to the rotor 21 and may be used to communicate the rotation of the rotor 21 to a tool or other apparatus. The rotor cover 17 may optionally include a lining, or sleeve 18 received therein. The inside surface of the sleeve 18 provides a smooth surface for the vanes 25.

In the preferred embodiment of the invention, as illustrated in FIG. 1, the end plate 19 is shown to be of unitary construction with the rotor cover 17, while end plate 19' is shown to be fabricated as an independent component. It is important to note that either, or neither end plate 19 or 19' may be formed integral with the rotor cover 17. It is preferable, however, that at least one of the end plates be secured to the rotor cover 17 by detachable fastener means, such as screws (not shown in the drawing) for purposes of assembly and repair.

It is also important to note that rotor cover 17 is illustrated in FIGS. 1 and 2 as being substantially cylindrical in shape and having the rotor 21 eccentrically mounted therein to form variable working volumes 27. Rotor cover 17 may, in fact, be elliptical in transverse cross section and have rotor 21 centrally located therein. Other crosssectional configurations, which include a plurality of lobes, may be used so long as the configuration still permits the cooperation of the rotor 21, housing 15, and vanes 25, to form variable working volumes 27.

Referring once again to FIG. 1, the end plates 19 and 19' have coaxial bores 35 formed therein. A ball bearing 37 which includes an outer race 39, an inner race 41 and a plurality of balls 43 rotatably secured between the races, is coaxially mounted in each end plate bore 35. It is preferred that the inside diameter of the bore 35 and the outside diameter of the outer race 39 be matched to permit a slip fit between the bearings 37 and bores 35. In this matter, the outer race 39 of each bearing 37 is radially supported in the end plate bore 35 yet the inner race 41 remains rotatable with respect to the housing 15.

Figure 4:
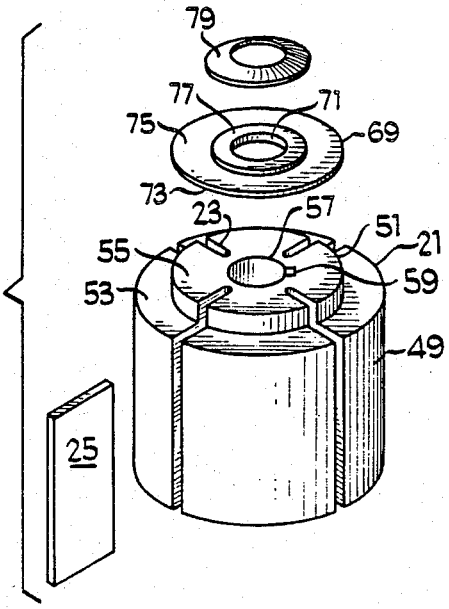
FIG. 4 is a perspective, exploded view of the rotor, vanes, sealing washer and axial compression spring means illustrated in FIGS. 1 -3.

Referring now to FIGS. 1, 2 and 4 the rotor 21 has a relatively large diameter cylindrical working portion 49 disposed between a pair of coaxially located, relatively small diameter, cylindrical, rotor end portions 51, which portions define axial faces 53 and 55, respectively. Radial slots 23 extend the entire axial length of the rotor 21 so as to penetrate axial faces 53 and 55.

Permitting radial slots 23 to run the entire axial length of rotor 21 permits easy and economical fabrication of the rotor by powder metallurgy techniques. In powder metallurgy fabrication, powdered metal is compacted with a punch, in a die of a desired configuration. The consolidated powder part, or "green" part, is then removed from the die and subjected to sintering which metallurgically bonds the individual powder particles. The ejection of a green, powder metal part from a die is made particularly difficult when the part contains holes or recesses which are "blind" with respect to the direction of punch travel. Such parts often require dies which are split in the axial plane of the punch or which include removable pattern portions. Thus, by causing radial slots 23 to penetrate faces 53 and 55, the need for an axially split die for the powder metallurgy manufacture of the rotor 21 is eliminated.

As shown in the drawings, rotor 21 is rotatably mounted in housing 15 so that rotor end portions 51 are received in end plate bores 35 in a journaled manner. The drive shaft 33 is fabricated independent of the rotor 21 and is received in a coaxial bore 57 formed in the rotor. The drive shaft 33 is torsionally affixed to the rotor 21 by means of an axial keyway 59 extending from the bore 57, and an abbreviated keyway, or Woodruff keyway, 61 in drive shaft 33, each of which keyways receives key 63. Because keyway 59 runs the entire axial length of the rotor 21, the rotor 21 remains slidable, in the axial direction, with respect to the drive shaft 33. Nonetheless, because key 63 extends radially from the abbreviated keyway 61 in drive shaft 33, and engages keyway 59 in the rotor 21, the drive shaft 33 is torsionally affixed to rotor 21 so that rotation of rotor 21 is communicated to drive shaft 33.

The axial position of drive shaft 33 is secured with respect to housing 15 by means of retaining rings 65 which abut inner races 41. In the preferred embodiment of the invention, the diameter of drive shaft 33 is closely matched to the inside diameter of inner race 41 so that drive shaft 33 can be further fixed in the axial direction, with respect to the bearings 37 by press-fitting its ends in inner races 41. Drive shaft 33 is readily sized for press-fitting and, at the same time, axially trued, by the employment of centerless grinding.

By press-fitting drive shaft 33 in inner races 41, the drive shaft 33 remains rotatable with respect to housing 15 but remains securely fixed, with regard to axial displacement, between ball bearings 37. Thus, ball bearings 37 and drive shaft 33 are locked in an axial relation so that axial displacement with respect to the housing 15, of either, necessarily entails axial displacement of the other. The axial position of the drive shaft 33 and ball bearing 37 assembly, with respect to the housing 15, is limited by a pair of split retaining rings 47 which are received in the circumferential grooves 49 formed in outer races 39. A compression wave washer 67, disposed between one of the retaining rings 47 and end plate 19, causes the ball bearing 37 and drive shaft 33 assembly to resume a predetermined normal operating position upon any axial displacement thereof. Thus, the ball bearing 37 and drive shaft 33 assembly is said to "float" in the axial direction.

Figure 3:
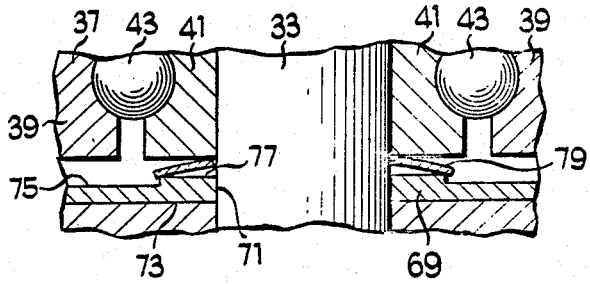
FIG. 3 is a fragmentary, enlarged view of the uppermost ball bearing, sealing washer and axial compression spring means associated therewith, shown in FIG. 1.

Referring now to FIGS. 1, 3 and 4, the rotor 21 is likewise permitted to "float", in an axial direction, with respect to drive shaft 33 and housing 15. A pair of sealing washers 69, each of which has a hole 71 formed therein are respectively disposed between the axial faces 55 and the ball bearings 37, the drive shaft 33 being located in hole 71. Each washer 69 includes a flat face 73 and a stepped face 75, which stepped face defines an abutting ring 77, disposed adjacent the hole 71. The washers 69 are oriented so that flat faces 73 abut axial faces 55 and abutting rings 77 lie adjacent inner races 41. Axial compression spring means, in the form of a spring washer 79, is disposed between one of the sealing washers 69 and inner race 41 of one of the ball bearings 37. Thus, because the rotor 21 is only torsionally affixed to drive shaft 33, and is slidable in the axial direction relative thereto, the rotor 21 also "floats". in the axial direction with respect to drive shaft 33 and housing 15. The axial displacement, or "float" of the rotor 21 is limited at one end (uppermost as viewed in FIG. 1) by spring washer 79 cooperating with inner race 41 and the abutting ring 77 of the adjacent sealing washer 69, and at the other end by contact between abutting ring 77 and the inner race 41. The permitted axial displacement, or "float" of the rotor 21 is, therefore, only unidirectional with respect to a predetermined normal operating position, defined by maximum extension of spring washer 79 so that abutting contact is maintained between: spring washer 79 and the inner race 41 and abutting ring 77 associated therewith; flat faces 73 of sealing washers 69 and axial faces 55 of rotor 21; and the abutting ring 77 and inner race 41, located at the axial end, opposite spring washer 79. The rotary motor 13 is preferably assembled so that the spring washer 79 is always in a state of compression, maintaining the rotor in its predetermined normal operating position. Any axial displacement of rotor 21 then causes spring washer 79 to exert a force on rotor 21, moving rotor 21 back to its predetermined normal operating position.

The above-described limitation on axial displacement of the rotor 21, with respect to the housing 15, is such that contact between axial faces 55 on rotor working portion 49 and end plates 19 and 19′ is avoided. Thus, scoring and wear of the rotor and end plates can be avoided.

It is important to note that abutting ring 77 and axial compression spring means 79 abut inner races 41 without contacting outer races 39 of bearings 37. This feature is best illustrated in FIG. 3 where it can be seen that the outside diameter of abutting ring 77 and spring washer 79 are made smaller than the inside diameter of outer race 39.

In addition to augmenting the "floating" feature of rotor 21, sealing washers 69 seal or cover radial slots 23 on axial faces 55. Flat faces 73 provide sealing means which help prevent the leakage of fluid between variable working volumes 27 across axial faces 55. Thus, the efficiency of operation and the power output of the rotary motor of the invention are not detrimentally affected by the slots 23 penetrating axial faces 55.

In its simplest embodiment (not shown in the Figures), the rotary motor of the invention includes only a single abutting ring 77, and a single axial compression spring means 79, disposed between opposite axial faces 55 of rotor end portion 51 and inner races 41, respectively. In this embodiment, the radial slots 23, formed in rotor 21, do not penetrate axial faces 55 of rotor end portions 51. Thus, the sealing function of the flat face 73 of sealing washer 69 is not needed. In this embodiment, spring washer 79 can cooperate directly with one axial face 55 and associated inner race 41 to axially locate rotor 21 in its predetermined normal operating position.

By limiting the length of the radial slots 23, so that they do not penetrate axial faces 55 of the rotor end portions 51, an additional embodiment of the invention is possible. In this embodiment, one or more of the abutting rings 77 may be made integral with the rotor end portion 51, so that axial face 55 presents a stepped face, which defines the abutting ring 77.

The invention consists of certain novel features and a combination of parts, previously described, illustrated in the drawings, and particularly pointed out in the appended claims. While there has been described what is, at present, considered to be a preferred embodiment, it will be understood that various changes in the details may be made without departing from the spirit, or sacrificing any of the advantages of the invention.

What is claimed is:

1. In a fluid driven rotary motor of the type comprising:

a rotor housing which includes a rotor cover disposed between a pair of end plates;

the end plates each having a bore formed therein;

a rotor having a relatively large diameter, cylindrical working portion disposed between a pair of relatively small diameter, cylindrical end portions, the working portion defining a pair of axial faces, a drive shaft which defines opposite ends and which is coaxial with the rotor and torsionally affixed thereto;

the rotor having a plurality of radially extending slots formed therein;

a plurality of vanes respectively slidably received in the slots;

two bearings each having an inner race and an outer race and being respectively mounted in the end plate bores so as to be radially supported therein;

the rotor and the drive shaft being rotatably mounted in the housing, the rotor end portions and the drive shaft ends being journaled in the end plate bores and the inner bearing races, respectively; and the housing, the end plates, the rotor and the vanes cooperating with one another to define an plurality of variable, working volumes, whereby the introduction of a compressed fluid into the working volumes, its expansion therein and subsequent exhaust therefrom causes rotation of the rotor and the drive shaft;

the improvement comprising:

means for axially fixing the opposite ends of the drive shaft to the inner races;

the rotor being axially slidable with respect to the drive shaft;

an abutting ring having a hole formed therein and being intermediate one of said rotor end portions and the inner race of the bearing associated therewith so that said drive shaft is received in said hole;

said abutting ring abutting the inner race of the bearing associated therewith, and not contacting the outer race thereof;

axial compression spring means disposed between the other rotor end portion and the inner race of the bearing association therewith;

said axial compression spring means abutting the other rotor end portion and the inner race of the bearing associated therewith, and not contacting the outer race thereof; and axial displacement of the rotor, with respect to the housing, being limited by said abutting ring and said axial compression spring means cooperating with the rotor end portions and the inner races of the bearings associated therewith, respectively, so that contact between on the working rotor portion and the end plates is avoided.

2. The fluid driven rotary motor in accordance with claim 1, wherein said abutting ring and the rotor end portion associated therewith are separate parts.

3. In a fluid driven rotary motor of the type comprising:

a rotor housing which includes a rotor cover disposed between a pair of end plates;

the end plates each having a bore formed therein;

a rotor having a relatively large diameter, cylindrical working portion disposed between a pair of relatively small diameter cylindrical end portions, the working portion defining a pair of axial faces, each of the end portions defining a single axial face;

a drive shaft which defines opposite ends and which is coaxial with the rotor and torsionally affixed thereto;

the rotor having a plurality of radially extending slots formed therein;

a plurality of vanes respectively slidably received in the slots;

two bearings, each having an inner race and an outer race, and being respectively mounted in the end plate bores so as to be radially supported therein;

the rotor and the drive shaft being rotatably mounted in the housing, the rotor end portions and the drive shaft ends being journaled in the end plate bores and inner bearing races, respectively; and the housing, the end plates, the rotor and the vanes cooperating with one another to define a plurality of variable, working volumes, whereby the introduction of a compressed fluid into the working volumes, its expansion therein and subsequent exhaust therefrom causes rotation of the rotor and drive shaft;

the improvement comprising:

means for axially fixing said opposite ends of the drive shaft to said inner races;

the rotor being slidable, in the axial direction with respect to the drive shaft;

the radially extending slots extending the entire axial length of the rotor so as to penetrate the axial faces of said rotor end portions;

a pair of sealing washers, which washers each have an hole formed therein, a flat face and a stepped face, which stepped face presents an abutting ring, the washers being disposed between the axial face of each rotor end portion and the inner race of each bearing associated therewith, such that the drive shaft is received in the hole, the flat face of the sealing washers abutting the axial face of each rotor end portion and covering the penetrating radially extending slots, and the abutting ring of one of the sealing washers abutting the inner race of the bearing associated therewith and not contacting the outer race thereof;

axial compression spring means disposed intermediate the abutting ring of the other sealing washer and the inner race of the bearing associated therewith, and abutting said abutting ring and inner race and not contacting the outer race of said associated bearing;

axial displacement of the rotor, with respect to the housing, being limited by said axial compression spring means cooperating with said abutting ring and inner race associated therewith and said other abutting ring abutting said other inner race associated therewith, so that contact between the axial faces on said working portion and said end plates is avoided and, the rotor having a predetermined normal operating position defined by maximum extension of the axial compression spring means, said axial compression spring means being operative to force the rotor to return to said predetermined operating position upon axial displacement of the rotor.

4. An improved, fluid driven rotary motor in accordance with claim 3 wherein the improvement further comprises said axial compression spring means being a spring washer.

5. In a fluid driven rotary motor of the type comprising:

a rotor housing which includes a rotor cover disposed between a pair of end plates;

the end plates each having a bore formed therein;

a rotor having a relatively large diameter, cylindrical working portion disposed between a pair of relatively small diameter, cylindrical end portions, the working portion defining a pair of axial faces, each of the end portions defining a single axial face;

a drive shaft which defines opposite ends and which is coaxial with the rotor and torsionally affixed thereto;

the rotor having a plurality of radially extending slots formed therein;

a plurality of vanes respectively slidably received in the slots;

two bearings each having an inner race and an outer race and being respectively mounted in the end plate bores so as to be radially supported therein;

the rotor and the drive shaft being rotatably mounted in the housing, the rotor end portions and the drive shaft ends being journaled in the end plate bores and the inner bearing races, respectively; and the housing, the end plates, the rotor and the vanes cooperating with one another to define a plurality of variable, working volumes, whereby the introduction of a compressed fluid into the working volumes, its expansion therein and subsequent exhaust therefrom causes rotataion of the rotor and the drive shaft;

the improvement comprising:

means for axially fixing the opposite ends of the drive shaft to the inner races;

the rotor being axially slidable with respect to the drive shaft;

an abutting ring having a hole formed therein and being disposed intermediate the axial face of one of said rotor end portions and the inner race of the bearing associated therewith so that said drive shaft is received in said hole;

said abutting ring abutting the axial face of the rotor end portion and inner race of the bearing associated therewith, and not contacting the outer race thereof;

axial compression spring means disposed between the axial face of the other rotor end portion and the inner race of the bearing associated therewith;

said axial compression spring means abutting the axial face of the other rotor end portion and the inner race of the bearing associated therewith, and not contacting the outer race thereof; and axial displacement of the rotor, with respect to the housing, being limited by said abutting ring and said axial compression spring means cooperating with the axial faces on the rotor end portions and the inner races of the bearings associated therewith, respectively, so that contact between the axial faces on the working rotor portion and the end plates is avoided.

6. The fluid driven rotary motor in accordance with claim 1 wherein the rotor working portion and rotor end portions are integral.

7. The fluid driven rotary motor in accordance with claim 1, wherein said axial compression spring means is a spring washer.

8. The fluid driven rotary motor in accordance with claim 7 wherein the rotor has a predetermined normal operating position defined by the maximum extension of said spring washer, said spring washer being operative to force the rotor to return to said predetermined normal operating position upon axial displacement of the rotor.

9. The fluid driven rotary motor in accordance with claim 1, wherein the outer race of each bearing has a retaining ring affixed thereto and further axial compression spring means is disposed between one of said retaining rings and the end plate associated therewith, said bearings and drive shaft having a predetermined normal operating position defined by the maximum extension of said further axial compression spring means, said further axial compression spring means being operative to force the bearings and drive shaft to return to said normal operating position upon axial displacement thereof.

10. The fluid driven rotary motor in accordance with claim 9 wherein said further axial compression spring means is a wave washer.

11. The fluid driven rotary motor in accordance with claim 1, wherein the improvement further comprises a further abutting ring disposed between said axial compression spring means and the axial face of the other rotor end portion.

12. The fluid driven rotary motor in accordance with claim 11, wherein the radially extending slots extend the entire axial length of the rotor so as to penetrate the axial faces of the rotor end portions; and sealing means is disposed against the axial face of each of the rotor end portions, and covering said penetrating radially extending slots.

13. The fluid driven rotary motor in accordance with claim 12 wherein said abutting rings and sealing means are in the form of sealing washers, each sealing washer having said hole formed therein, sealing means in the form of a flat face, and a stepped face, which stepped face presents said abutting ring.

* * * * *